US006443782B1

(12) United States Patent
Mitani

(10) Patent No.: US 6,443,782 B1
(45) Date of Patent: Sep. 3, 2002

(54) JOINT CONNECTOR

(75) Inventor: Yumi Mitani, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/921,726

(22) Filed: Aug. 3, 2001

(30) Foreign Application Priority Data

Oct. 8, 2000 (JP) ..... 2000-242739

(51) Int. Cl.[7] ..... H01R 13/436
(52) U.S. Cl. ..... 439/752; 439/507; 439/701
(58) Field of Search ..... 439/752, 507, 439/511, 513, 189, 701, 651, 652

(56) References Cited

U.S. PATENT DOCUMENTS 5,556,301 A * 9/1996 Chishima et al. ..... 439/507
5,707,254 A * 1/1998 Chishima et al. ..... 439/507
5,980,331 A * 11/1999 Matsushita et al. ..... 439/752
5,997,362 A * 12/1999 Hatagishi et al. ..... 439/701
6,036,552 A * 3/2000 Atsumi ..... 439/752
6,068,522 A * 5/2000 Aoyama et al. ..... 439/701

FOREIGN PATENT DOCUMENTS

JP 6-349538 12/1994

* cited by examiner

*Primary Examiner*—Gary F. Paumen
(74) *Attorney, Agent, or Firm*—Anthony J. Casella; Gerald E. Hespos

(57) ABSTRACT

There is provided a joint connector that allows the number of assembling process to be decreased. The connector includes a conductive metal plate (50) secured on a retainer (40). When the retainer (40) is assembled onto the housing (11), the retainer (40) engages terminals 30 in the housing (11), thereby conductively connecting the terminals 30.

10 Claims, 9 Drawing Sheets

JOINT CONNECTOR

BACKGROUND OF THE INVENTION

1. Field of the Invention

The invention relates to a joint connector.

2. Description of the Related Art

A conventional joint connector is identified by the numeral 1 in FIG. 12 and also is disclosed in Japanese Unexamined Patent Publication No. (Hei) 06-349538. The joint connector 1 has a synthetic resin housing 2. Cavities 3 are stacked vertically in two parallel tiers in the housing 2, and are configured respectively to accommodate metal terminals 4. One wall of each cavity 3 is formed with an elastically displaceable lock piece 5 for engaging the metal terminal 4 inserted into the cavity 3. Thus, the metal terminal 4 is supported in the cavity 3 against a pulling force.

The housing 2 also has a groove 6 formed between the upper and lower tiers of cavities 3. A plate-shaped metal joint terminal 7 can be fit in the groove 6 to connect the respective metal terminals 4 to each other.

Many joint connectors require a retainer to achieve double engagement of the metal terminals in the housing. However, mounting work becomes complicated with the joint connector described above, due to the increase in the number of components such as joint terminals, retainers, and the like.

The present invention was made with reference to the above problems, and the objective of the present invention is to provide a joint connector with improved assembling workability.

SUMMARY OF THE INVENTION

The invention relates to a connector that has a housing and a plurality of cavities extending through the housing. Metal terminals can be mounted in the cavities and are locked redundantly in place by a retainer. A conductive plate or several conductive metal plates are secured on the retainer. The retainer is assembled into a formal engaging position in the housing, so that the retainer engages the metal terminals and so that the conductive plate contacts the metal terminals, thereby making each metal terminal conductively connectable.

The retainer and the conductive plate are integrated into one unit, thereby enabling the assembly onto the housing at one time, improving the assembling workability, and maintaining fewer components compared with the case in which a retainer and a conductive plate are separate pieces. Thus, component management is simpler.

DETAILED DESCRIPTION OF THE PREFERRED EMBODIMENT

Figure 1:
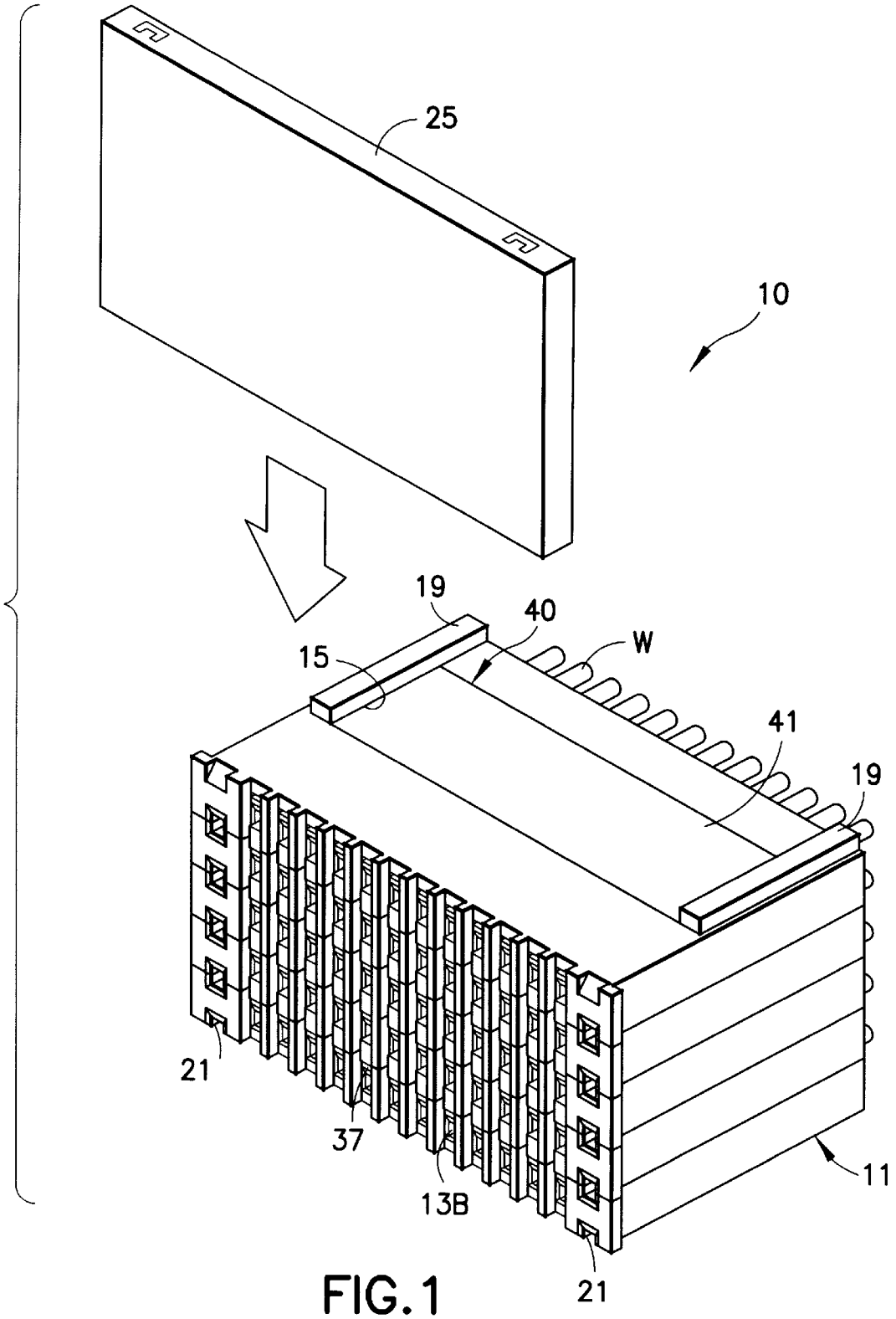
FIG. 1 represents a perspective view showing a joint connector of the present embodiment.

FIG. 1 shows a multi-stage joint connector 10 of the present embodiment. The joint connector 10 comprises five tiers of flat housings 11 that are stacked vertically on one another. The connector 10 further includes a retainer 40 for locking metal terminals in the respective flat housings 11, as explained in detail below. Additionally, the front face of the connector 10 is covered with a cover 25.

Figure 2:
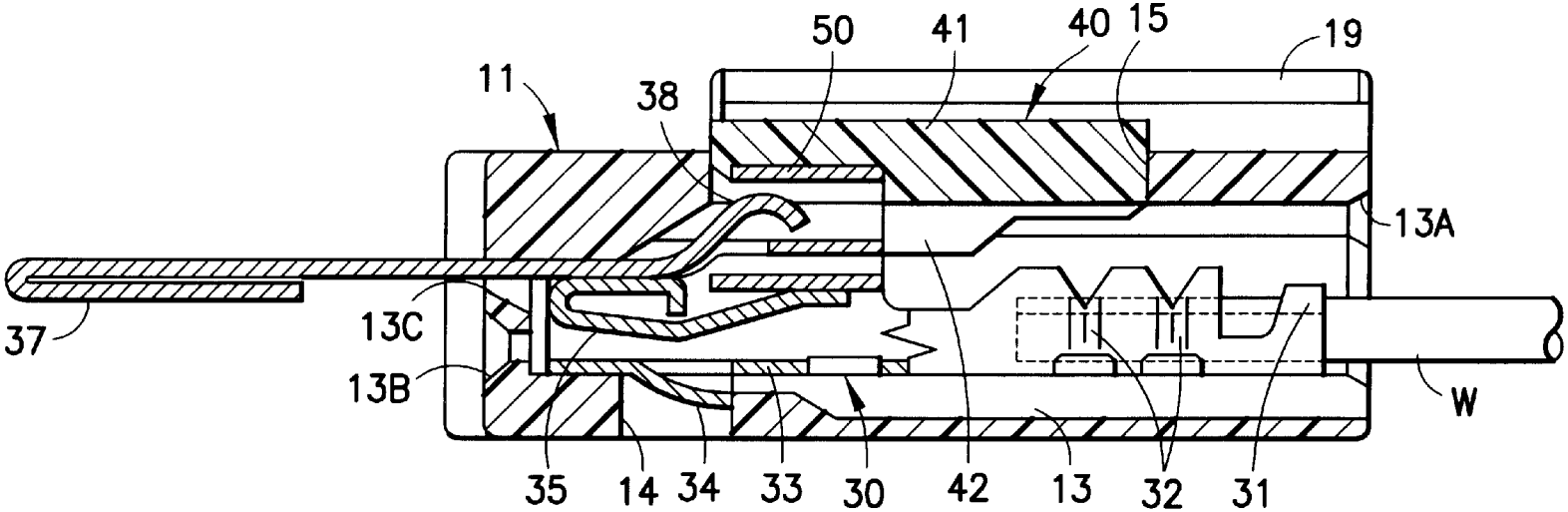
FIG. 2 represents a sectional side view showing a condition in which a terminal metal is inserted into a housing.
Figure 3:
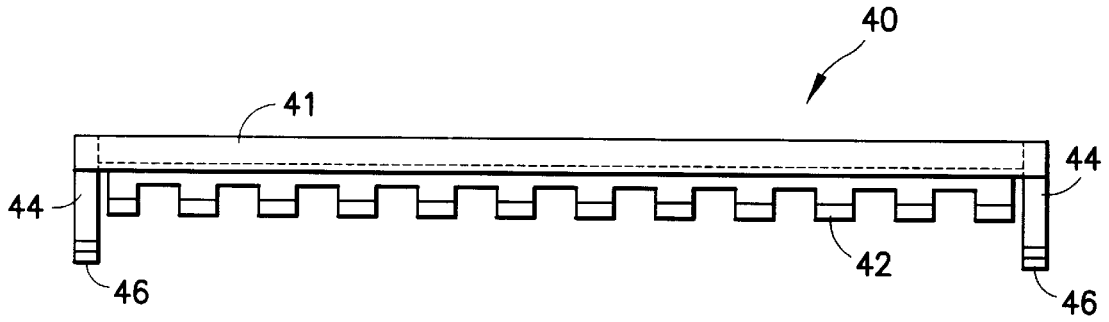
FIG. 3 represents a front view of a retainer.
Figure 4:
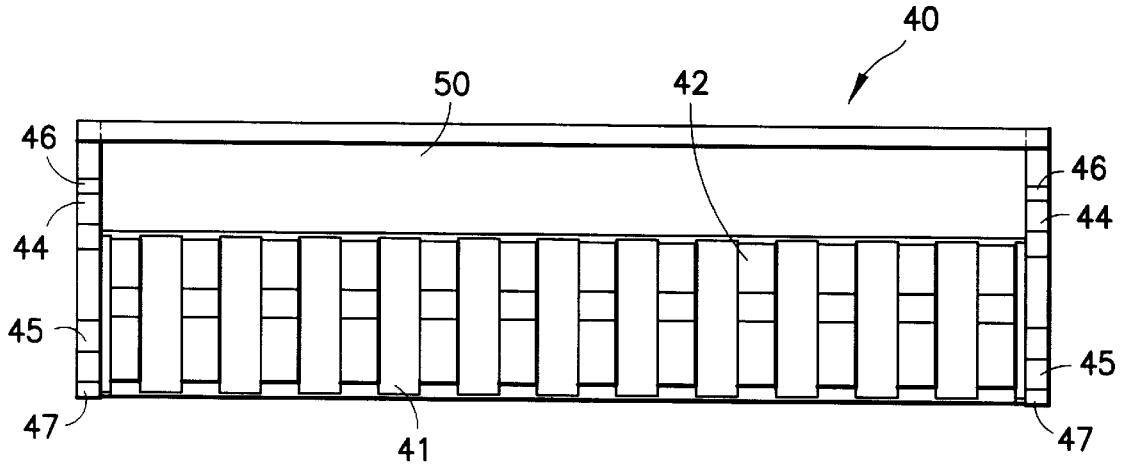
FIG. 4 represent a bottom view of a retainer.
Figure 5:
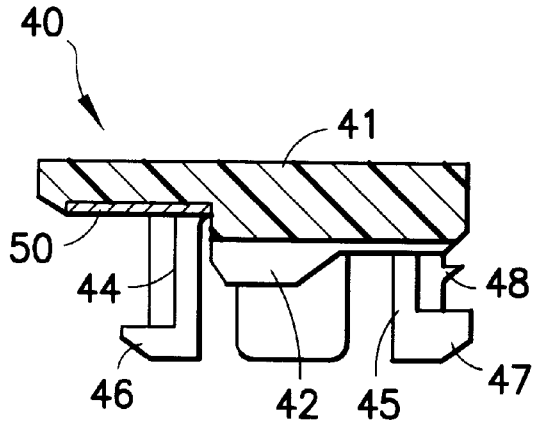
FIG. 5 represent a sectional side view showing a retainer.

Each housing 11 is formed integrally of synthetic resin and defines a flat box form, as shown in FIG. 1 and FIG. 2. A horizontal array of parallel cavities 13 is formed in each housing 11. Each cavity 13 is configured to accommodate a metal terminal 30.

Each cavity 13 is opened back and forth. The backside of each cavity 13 is opened widely, and functions as a terminal insertion inlet 13A for inserting a metal terminal metal 30. The front side of each cavity 13 has two openings disposed respectively at the upper and lower sides. The opening at the lower side is a terminal connecting opening 13B that allows insertion of a male tab 37 of another metal terminal metal 30 located immediately below. The opening at the upper side is a tab lead through opening 13C that leads through the male tab 37 of the metal terminal 30 mounted in the cavity 13. A lance engaging hole 14 is formed at the front of the bottom wall of each cavity 13, and allows engagement with a lance of the metal terminal 30. In addition, a retainer mounting hole 15 is formed in the upper wall of the housing 11 and opens to the ceiling face of each cavity 13. The retainer mounting hole 15 allows a retainer 40 to be mounted, as explained below.

Figure 6:
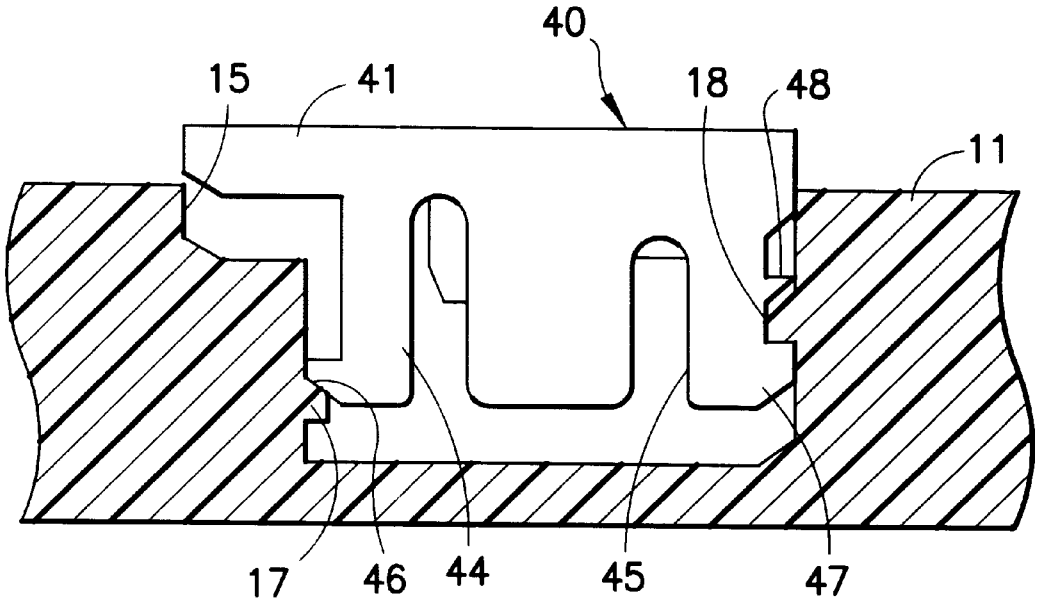
FIG. 6 represents a sectional side view showing a retainer at a provisionally engaging position.

The side ends of retainer mounting hole 15 have first and second retainer engaging protrusions 17 and 18 that allow engagement with engaging feet 44 and 45 of retainer 40, as shown in FIG. 6.

Slide projections 19 extend along forward and backward directions on the left and right upper sides of the housing 11. The slide projections 19 are narrow adjacent the upper side of the housing 11, but broaden at locations spaced from the upper side of the housing 11. On the other hand, right and left sides of the bottom face of housing 11, are formed with slide grooves 21 that extend along a forward and backward direction.

The slide grooves 21 have a near-dovetail shape that allows the slide projections 19 to be slideably received therein. The slide projections 19 are allowed to be slideably engaged within the sliding grooves 21 for movement in forward and backward directions. The slide projections 19 and the sliding grooves 21, are engaged in an inseparable manner and enable a pair of housings 11 to be stacked vertically.

A cover 25 is assembled on the front face of five tiers of vertically stacked housings 11, as shown in FIG. 1. The cover 25 is substantially flat, and is made of synthetic resin material. Thus, the cover 25 protects the metal terminals 30 exposed on the front face.

The metal terminal metal 30 is formed by punching out a conductive metal plate into a predetermined shape and then pressing the punched metal plate in a bending process. A barrel 31 is provided on the back end face for fastening to the wire cable W by caulking, and two pressure welding areas 32 are provided in front of the barrel 31. The wire cable W can be pressed from above, so that the pressure welding area 32 bites into the cladding of wire cable W and makes direct contact with the inside core wire.

A connecting area 33 is provided on a front area of the terminal 30 for connecting with a jointing counterpart terminal. The connecting area 33 is formed into a near-rectangular cylinder that is opened back and forth. The bottom face of the connecting area 33 includes a lance 34 that is elastically deformable vertically. The lance 34 is folded over and formed to slant toward the back side. The lance 34 elastically engages in the lance engaging hole 14 and the metal terminal 30 is supported inside the cavity 13 in a condition that substantially prevents rearward pulling. The ceiling wall on the connecting area 33 is a double walled structure.

An upwardly turned elastic contact piece 35 extends from the front end of the ceiling wall and is located inside the double structure to form an elastic contact piece 35.

Figure 8:
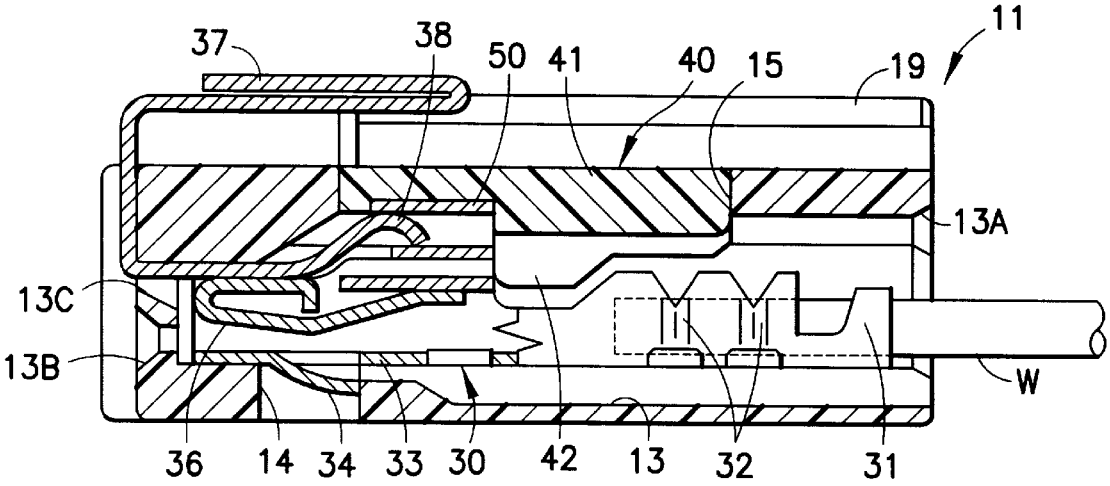
FIG. 8 represent a sectional side view showing a condition in which a retainer engaged with a terminal metal.

A male tab 37 protrudes forwardly from a location on the ceiling wall that defines the outside face of connecting area 33. The top of this male tab 37 can be inserted into a connecting area 33 of the terminal 30 located on the upper tier by turning the tab 37 up in a near U-shape with 2 positions bent at a right angle, as shown in FIG. 8.

The elastic contact by the elastic contact piece 35 with the male tab 37 can be electrically conductive with the upper and lower terminals 30.

Tabs 37 that are not necessary to connect with the terminal 30 located immediately above are cut out from the base area by a circuit structure. In addition, a conductive piece 38 extends from the center of the ceiling wall on the connecting area 33. The conductive piece 38 is elastically deformable in a vertical direction and also is made contactable with a conductive plate 50 mounted on the retainer 40, as stated later.

The retainer 40 is formed of synthetic resin, and comprises a thin rectangular flat plate 41. The flat plate 41 closes an upper opening of each cavity 13 when the retainer 40 is mounted on a retainer mounting hole 15. Terminal engaging projections 42 are provided on the lower face of the flat plate 41, and are in positions that correspond with each respective cavity 13. Thus, the terminals 30 inside the cavity 13 are engageable by the projections 42.

Two engaging feet 44 and 45 project downward from each of the right and left ends of the flat plate 41 and at the respective front and rear sides.

A first engaging protrusion 46 protrudes forward from the front tip of the engaging foot 44. On the other hand, a second engaging protrusion 47 protrudes backward from the tip of the engaging foot 45. A third engaging protrusion 48 protrudes backward approximately at the center of the back side engaging foot. The retainer 40 fits in the retainer mounting hole 15, as shown in FIG. 6, such that the first engaging protrusion 46 first strikes on the engaging protrusion 17 of the first retainer on the retainer mounting hole 15. Similarly, the second engaging protrusion 47 gets over the engaging protrusion 18 of the second retainer and is held at a provisional engaging position that engages with this protrusion. The provisional engaging position enables insertion of the terminal 30 into the cavity 13 of terminal 30 (See FIG. 2).

Figure 7:
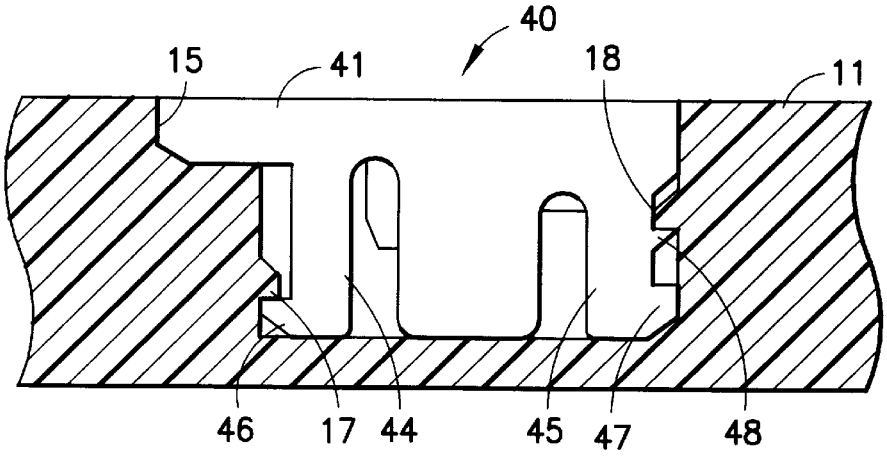
FIG. 7 represents a sectional side view showing a retainer at a provisionally engaging position.

The retainer 40 can be fit deeper than the position of provisional engaging position, as shown in FIG. 7. More particularly, the first engaging protrusion 46 engages and gets over the first retainer engaging protrusion 17, and the third engaging protrusion 48 engages and gets over second retainer engaging protrusion 18. Accordingly, the retainer 40 is held at this engaging position, and the terminal engaging projections 42 engage the terminals 30 inside the cavity 13 and resist pulling (see FIG. 8). The lower front face of flat plate 41 has a thin flat conductive plate 50 formed over nearly the entire width of the retainer 40. The conductive plate 50 is secured to the flat plate 41 by such means as, for instance, insert molding, bonding, pressure welding and the like. This conductive plate 50 permits a conductive connection between terminals 30 by contacting the conductive pieces 38 of metal 30 for each cavity 13 at this engaging position.

Figure 9:
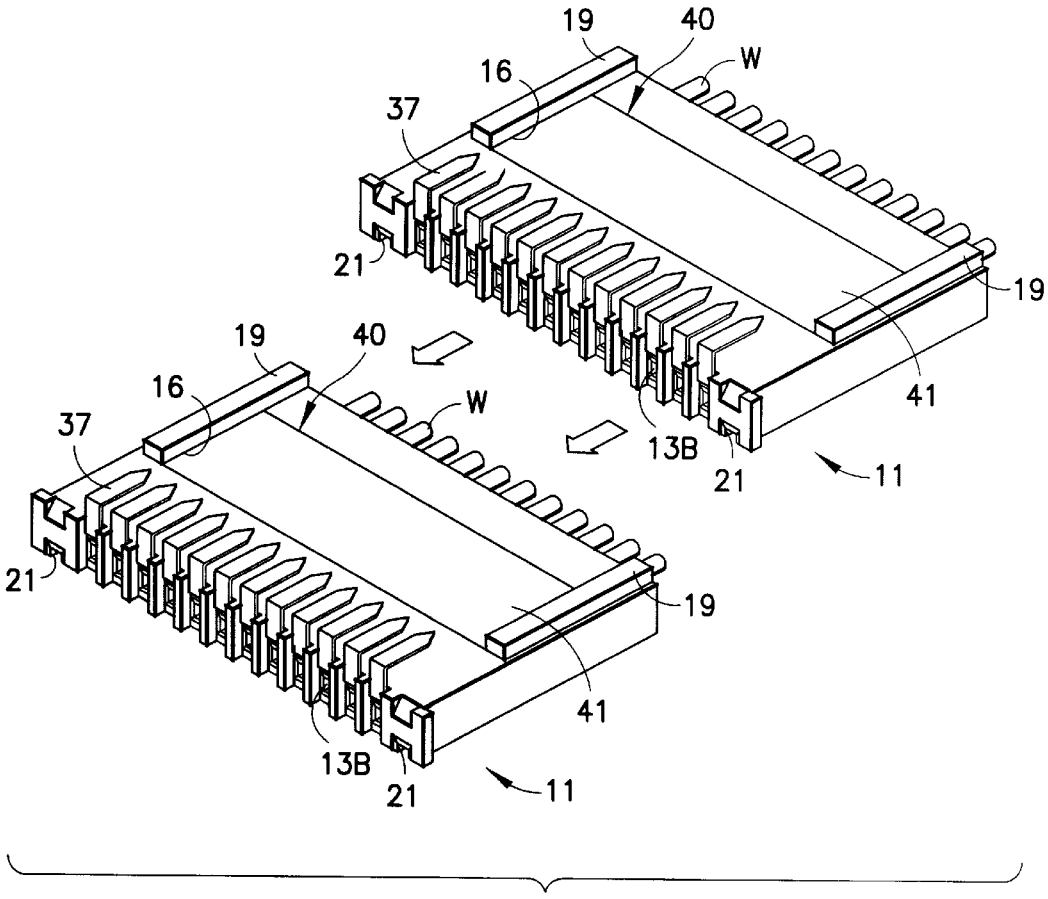
FIG. 9 represents a perspective view showing a condition in which housing on the upper and the lower positions are assembled.
Figure 10:
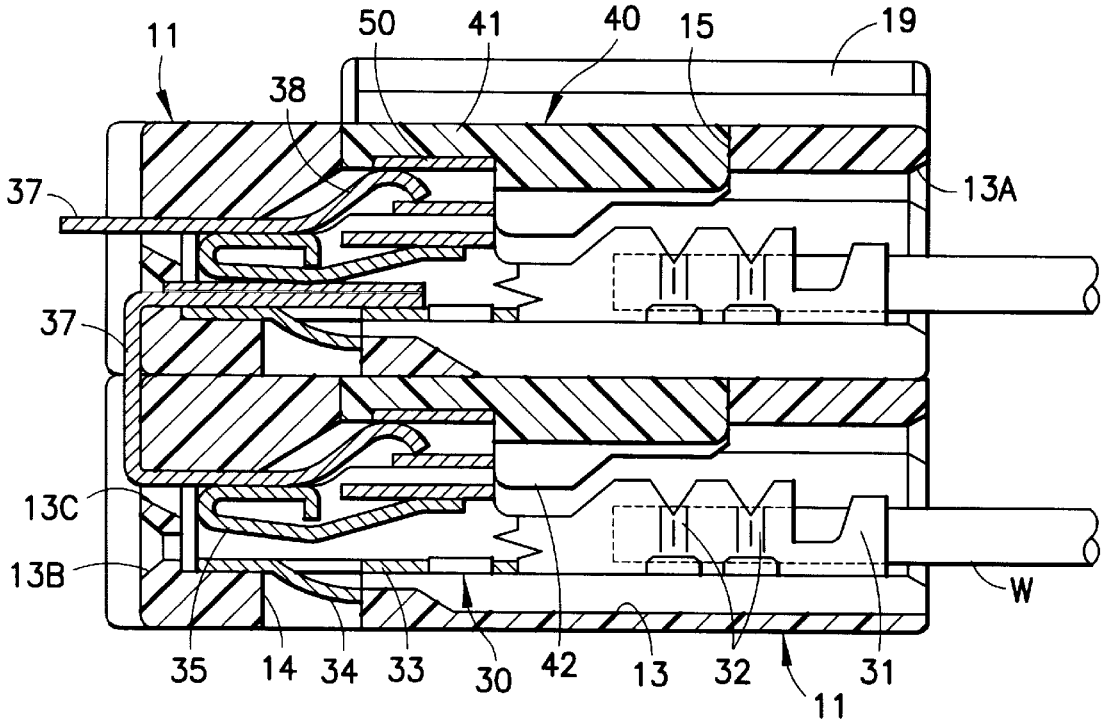
FIG. 10 represents a sectional side view showing a condition in which housing on the upper and the lower positions are assembled.

The retainer 40 is assembled onto the retainer mounting hole 15 at a provisional engaging position, and terminals 30 are inserted into each cavity 13. Insertion of the terminal 30 into the depth of the cavity 13 causes the lance 34 to engage with a lance engaging hole 14 (see FIG. 2). Then, the retainer 40 is pushed forward to this engaging position. As a result, the terminal engaging protrusion 42 engages the connecting area 33 of terminal 30, and the terminal 30 is held inside the cavity in a double-engaged condition. Simultaneously, the conductive plate 50 is pushed against the conductive piece 38, and each of the terminals 30 are electrically conducted through a conductive plate 50 (see FIG. 8). Following this, a male tab 37 that protrudes from the housing 11 is bent in 2 tiers (in this case, areas that need not connect with the terminal 30 of upper tier, namely, a male tab 37 of terminal 30 located on the top tier is cut off.) Each slide projection 19 on the lower side of the housing 11 then is slid forward to fit into the respective sliding grooves 21 on the upper side of the housing 11 (see FIG. 9). Simultaneously, the tip of the male tab 37, which protrudes from the lower side of the housing 11, enters into a cavity 13 from the terminal connecting opening 13B on the upper side of the housing 11, and terminals 30 on the upper and lower sides are connected electrically (see FIG. 10).

Assembly is completed by stacking the housings 11 vertically in five tiers and covering the front face with the cover 25.

As mentioned above, the retainer 40 and conductive plate 50 are integrated into one unit, and are assembled into the housing 11 at one time, thereby improving an assembling workability. In addition, the number of components is less and component management is simpler compared with the case where components consisting of the corresponding retainer and conductive plate are chosen separately.

The terminals 30 are aligned in a horizontal direction. Thus, conductive connection can be made by a conductive plate 50 that is integrated with the retainer 40. Additionally, the terminals 30 are aligned vertically with the male tabs 37. Therefore, conductive connection can be made by with the male tabs 37. As a result, the assembling workability can be improved even with the multi-tier connectors.

With the aforementioned embodiment, the terminals 30 of the joint connector 10 were described as examples of a common connection through a conductive plate 50 and male tab 37. However, application can be made to more complicated circuits.

Figure 11:
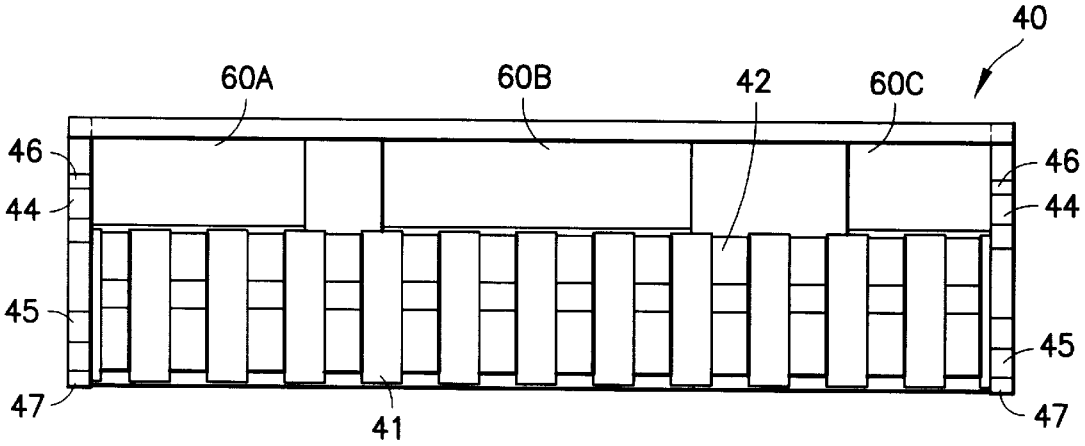
FIG. 11 represents a bottom view showing an example in which mother conductive plate is stuck on a retainer.
Figure 12:
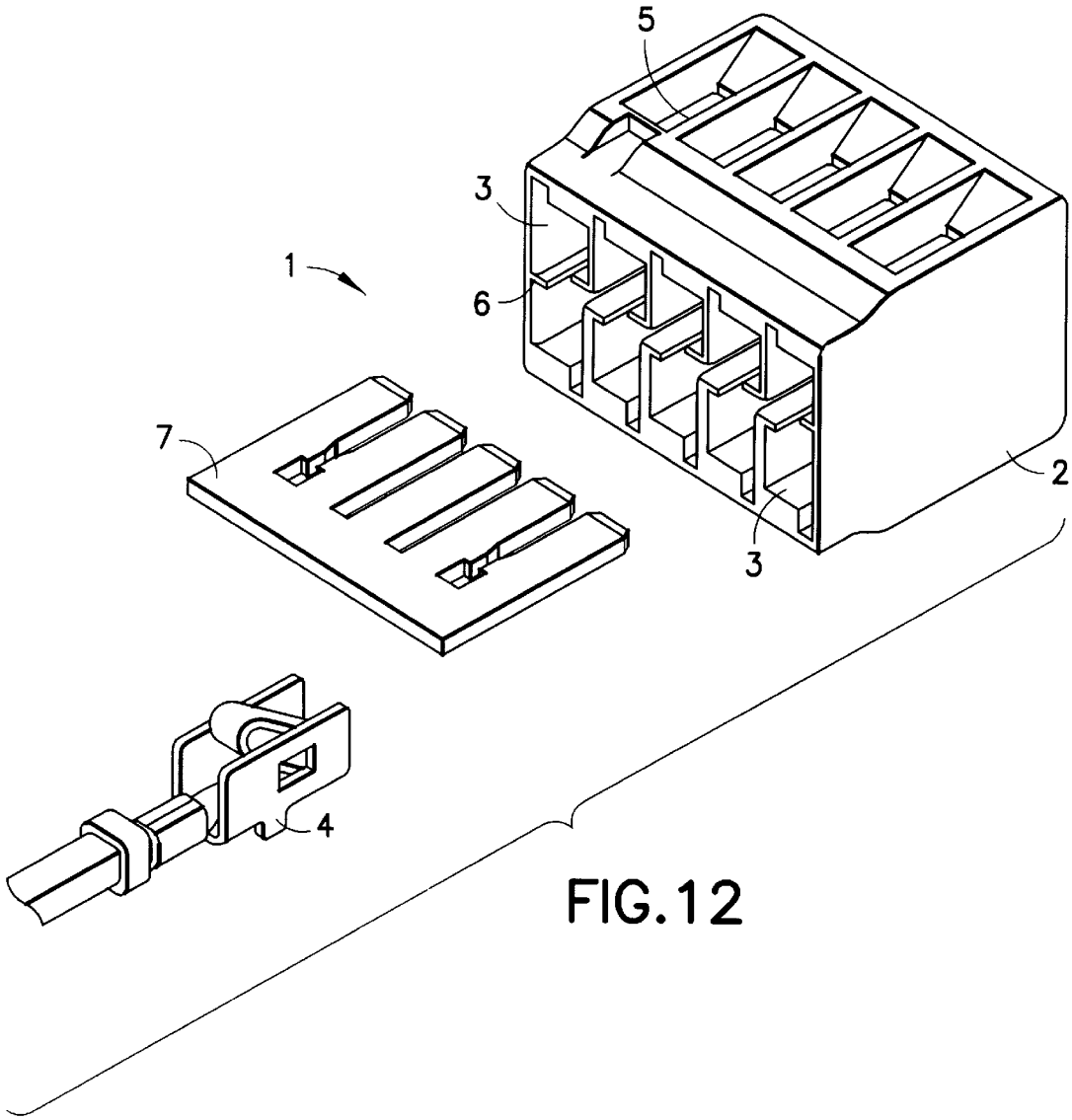
FIG. 12 represents a perspective view showing a conventional joint connector.

For instance, as shown in FIG. 11, a plural number of conductive plates 60A, 60B, and 60C may be adhered on a retainer 40 according to circuit structure. In this case, a male tab 37 of the terminal 30 can properly be cut off according to the circuit structure. When directly assembling a plural number of conductive members, the number of components and of processes for assembling work become increased. The integration of conductive members and a retainer into one unit, as mentioned above, can assure simpler assembling work.

The scope of technology of the present invention is not restricted to the embodiment described in the aforementioned description. For instance, the following is also included in the scope of technology of the present invention.

With the aforementioned embodiment, although a multi-tier joint connector was shown, the present invention may be applied to other kinds of joint connectors.

With the aforementioned embodiment, a conductive plate 50 integrated into a retainer 40 connects terminals 30 aligned in a horizontal direction. However, according to the present invention, for instance, a retainer may be formed in a lattice, and vertically aligned terminals may be connected through conductive members on the lattice-shaped retainer.

Although the conductive plate 50 of the aforementioned embodiment is a metal plate, according to the present invention, it may be possible for a conductive member to be a retainer taped with a conductive tape, or one coated with a conductive paint.

What is claimed is:

1. A joint connector; comprising, a housing (11) with a plurality of cavities (13) allowing a plurality of terminals (30) to be accommodated therein, a retainer (40) mounted on the housing (11) and engaged with the terminals (30) for locking the terminals (30) in the cavities (13), and a conductive member (50) for conductively connecting the terminals (30); whereby, the conductive member (50) being integrated with the retainer (40).

2. A joint connector as set forth in claim 1, wherein, the retainer (40) is mountable on a retainer mounting hole (15) that is open to ceiling faces of the cavities (13) on an upper wall of the housing (11), the conductive member (50) being adhered to a face of the retainer (40).

3. A joint connector as set forth in claim 2, wherein, a conductive piece (38) elastically contactable with the conductive member (50) of the retainer (40) is integrally provided on the terminal (30).

4. A joint connector as set forth in claim 3, wherein, a plurality of the cavities (13) are provided in a horizontal direction and parallel to one another on the housing (11);

a plurality of the housings being stacked vertically in tiers for allowing the housings to be integrated into one unit, and a connecting member being provided for allowing the respective terminals (30) mounted on the upper and lower housings (11) to be conductively connected.

5. A joint connector, comprising:

a housing (11) having a front end, a rear end and an outer wall extending between the ends, a plurality of cavities (13) extending through the housing (11) from the front end to the rear end, a retainer opening (15) extending through the outer wall and communicating with the cavities (13);

terminals (30) mounted in the respective cavities (13);

a retainer (40) mounted in the retainer opening (15) for locking the respective terminals (30) in the cavities (13), and a conductive portion (50) secured to the retainer (40) and contacting the terminals (30).

6. The joint connector of claim 5, wherein the retainer (40) is unitarily formed from a plastic material.

7. The joint connector of claim 6, wherein the conductive portion (50) is unitarily formed from a metal material.

8. The joint connector of claim 7, wherein part of the conductive portion (50) is insert molded into the retainer (40) such that said part of the conductive portion (50) is surrounded by a unitary matrix of the plastic material from which the conductive portion (50) is formed.

9. The joint connector of claim 7, wherein the conductive portion (50) is secured to the retainer (40) by fusing.

10. The joint connector of claim 5, wherein the retainer (40) contacts a first surface on each said terminal (30), and wherein the conductive portion (50) contacts a second portion of each said terminal (30).

* * * * *